US012459080B2

(12) United States Patent
Nangoy et al.

(10) Patent No.: US 12,459,080 B2
(45) Date of Patent: Nov. 4, 2025

(54) CLEANING SYSTEM FOR POLISHING LIQUID DELIVERY ARM

(71) Applicant: Applied Materials, Inc., Santa Clara, CA (US)

(72) Inventors: Roy C. Nangoy, Santa Clara, CA (US); Shantanu Rajiv Gadgil, Santa Clara, CA (US); Nathan Arron Davis, Gilbert, AZ (US); Allen L. D'Ambra, Burlingame, CA (US); Michael J. Coughlin, Livermore, CA (US); Sumit Subhash Patankar, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 18/597,077

(22) Filed: Mar. 6, 2024

(65) Prior Publication Data

US 2024/0208006 A1 Jun. 27, 2024

Related U.S. Application Data

(63) Continuation of application No. 17/344,617, filed on Jun. 10, 2021, now Pat. No. 12,240,078.

(60) Provisional application No. 63/043,665, filed on Jun. 24, 2020.

(51) Int. Cl.

| | |
|---|---|
| ***B24B 57/02*** | (2006.01) |
| ***B24B 37/34*** | (2012.01) |
| ***B24B 53/017*** | (2012.01) |

(52) U.S. Cl.

CPC ..... *B24B 57/02* (2013.01); *B24B 37/34* (2013.01); *B24B 53/017* (2013.01)

(58) Field of Classification Search

CPC ..... B24B 57/02; B24B 53/017; B24B 37/34; B08B 3/02; B05B 1/044

See application file for complete search history.

(56) References Cited

U.S. PATENT DOCUMENTS

| | | | | |
|---|---|---|---|---|
| 5,421,768 | A * | 6/1995 | Fujiwara | B24B 53/017 451/286 |
| 6,053,801 | A | 4/2000 | Pinson | |
| 6,139,406 | A | 10/2000 | Kennedy et al. | |
| 6,206,760 | B1 | 3/2001 | Chang et al. | |

(Continued)

FOREIGN PATENT DOCUMENTS

| | | |
|---|---|---|
| CN | 1634681 | 7/2005 |
| CN | 201841472 | 5/2011 |

(Continued)

OTHER PUBLICATIONS

International Search Report and Written Opinion in International Appln. No. PCT/US2021/038981, dated Sep. 29, 2021, 8 pages.

(Continued)

*Primary Examiner* — Joel D Crandall
(74) *Attorney, Agent, or Firm* — Fish & Richardson P.C.

(57) ABSTRACT

A polishing liquid delivery arm cleaning tool includes a body configured to be removably secured to a polishing liquid delivery arm of a chemical mechanical polishing system, and an insert removably secured to the body. The insert has an arm-facing surface shaped to direct a cleaning fluid from the polishing liquid delivery arm back to an inner surface of an enclosure of the polishing liquid delivery arm.

15 Claims, 9 Drawing Sheets

(56) References Cited

U.S. PATENT DOCUMENTS

| | | | | |
|---|---|---|---|---|
| 6,283,840 | B1 * | 9/2001 | Huey | B24B 57/02 451/288 |
| 6,358,124 | B1 | 3/2002 | Koga | |
| 6,506,098 | B1 | 1/2003 | Ho et al. | |
| 6,626,743 | B1 * | 9/2003 | Boyd | B24B 21/04 451/299 |
| 7,014,552 | B1 * | 3/2006 | Collier | B24B 53/017 451/41 |
| 7,052,374 | B1 | 5/2006 | Lu et al. | |
| 8,382,013 | B2 * | 2/2013 | Pucciani | B05B 1/005 239/592 |
| 8,814,067 | B2 * | 8/2014 | Freers | B05C 11/06 239/548 |
| 9,352,446 | B2 * | 5/2016 | Liu | B24B 57/02 |
| 9,409,277 | B2 | 8/2016 | Umemoto et al. | |
| 9,592,585 | B2 | 3/2017 | Lin et al. | |
| 2003/0143933 | A1 * | 7/2003 | Baek | B24B 55/02 451/67 |
| 2003/0199229 | A1 * | 10/2003 | Vereen | B24B 37/04 451/36 |
| 2005/0107012 | A1 * | 5/2005 | Jae | B24B 53/017 451/41 |
| 2007/0298692 | A1 | 12/2007 | Mavliev et al. | |
| 2010/0112917 | A1 | 5/2010 | Leighton et al. | |
| 2014/0182633 | A1 | 7/2014 | Lin et al. | |
| 2014/0213158 | A1 | 7/2014 | Umemoto et al. | |
| 2015/0314417 | A1 | 11/2015 | Sun et al. | |
| 2016/0114459 | A1 * | 4/2016 | Butterfield | B24B 1/00 156/345.12 |
| 2016/0144478 | A1 * | 5/2016 | Kosuge | B24B 37/34 156/345.12 |
| 2016/0167195 | A1 * | 6/2016 | Diao | B24B 53/017 216/53 |
| 2019/0148160 | A1 * | 5/2019 | Nangoy | G01F 1/206 438/692 |
| 2020/0171621 | A1 | 6/2020 | Yamazaki et al. | |

FOREIGN PATENT DOCUMENTS

| | | |
|---|---|---|
| CN | 208020018 | 10/2018 |
| EP | 1038635 | 9/2000 |
| JP | 2003-133277 | 5/2003 |
| JP | 2012-148376 | 8/2012 |
| JP | 2015-044251 | 3/2015 |
| JP | 2019-209410 | 12/2019 |
| JP | 6671459 | 3/2020 |
| JP | 2020-082323 | 6/2020 |
| TW | 534851 | 6/2003 |
| TW | 200633039 | 9/2006 |
| TW | 201426833 | 7/2014 |
| TW | 201436936 | 10/2014 |
| TW | 201436947 | 10/2014 |
| TW | 201519967 | 6/2015 |
| WO | WO 2010/051284 | 5/2010 |

OTHER PUBLICATIONS

Office Action in Japanese Appln. No. 2022-580034, dated Dec. 4, 2023, 5 pages (with English summary).
Office Action in Taiwanese Appln. No. 111130035, dated Jul. 4, 2023, 9 pages (with English summary and search report).

* cited by examiner

CLEANING SYSTEM FOR POLISHING LIQUID DELIVERY ARM

CROSS-REFERENCE TO RELATED APPLICATIONS

This application is a continuation of U.S. application Ser. No. 17/344,617, filed Jun. 10, 2021, which claims priority to U.S. Application No. 63/043,665, filed on Jun. 24, 2020, the disclosures of which are incorporated by reference.

TECHNICAL FIELD

The present disclosure relates to chemical mechanical polishing, and more particularly to cleaning of a polishing liquid delivery arm that delivers a polishing liquid onto a polishing pad.

BACKGROUND

An integrated circuit is typically formed on a substrate by the sequential deposition of conductive, semiconductive, or insulative layers on a silicon wafer. One fabrication step during fabrication of an integrated circuit is to polish a filler layer to expose the top surface of an underlying insulating layer, e.g., to form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. A polishing liquid is typically supplied to the surface of the polishing pad by a polishing liquid delivery arm. The polishing liquid delivery arm may also have nozzles to spray a rinsing fluid onto the polishing pad to purge slurry or debris from the polishing surface.

SUMMARY

In one aspect, a polishing assembly includes a rotatable platen to support a polishing pad, a polishing liquid delivery arm having an enclosure open at a bottom thereof and one or more ports to deliver a polishing liquid and a cleaning fluid downwardly through an interior space of the enclosure onto the polishing pad, and a delivery arm cleaning tool removably attached to the polishing liquid delivery arm, the cleaning tool extending below the delivery arm and having a delivery arm-facing surface shaped such that the cleaning tool directs the cleaning fluid from the polishing liquid delivery arm on to a surface of the enclosure of the polishing liquid delivery arm.

In another aspect, a polishing liquid delivery arm cleaning tool has a delivery arm cleaning tool that includes an arm-facing surface shaped to direct cleaning fluid projected downwardly from a polishing liquid delivery arm back on to an inner surface of an enclosure of the polishing liquid delivery arm, and a retaining tab configured to secure the delivery arm cleaning tool to the polishing liquid delivery arm.

In another aspect, a polishing liquid delivery arm cleaning tool includes a body configured to be removably secured to a polishing liquid delivery arm of a chemical mechanical polishing system, and an insert removably secured to the body. The insert has an arm-facing surface shaped to direct a cleaning fluid from the polishing liquid delivery arm back to an inner surface of an enclosure of the polishing liquid delivery arm.

In another aspect, a method of cleaning a polishing liquid delivery arm includes installing a polishing liquid delivery arm cleaning tool to extend below an enclosure of a polishing liquid delivery arm, flowing a cleaning fluid through the polishing liquid delivery arm, and directing the cleaning fluid from the polishing liquid delivery arm off a surface of the cleaning tool back to a surface of the enclosure of the polishing liquid delivery arm.

Implementations may optionally include, but are not limited to, one or more of the following advantages. Polishing quality may be improved, e.g., fewer scratches and defects are created by dried abrasive particles from polishing slurry buildup detaching from the polishing liquid delivery arm during the polishing process. Additionally, the quantity of substrates scrapped due to defects can be reduced. Maintenance down time for the polishing system may be significantly decreased. The quality of the cleaning process may be improved, and difficult to access locations on the polishing liquid delivery arm can be cleaned more easily. This improves productivity of the polishing system and reduces operator time because less time is devoted to the polishing liquid delivery arm cleaning process. The cleaning process can be quickly modified by adjusting cleaning fluid pressure or cleaning fluid composition.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

During chemical mechanical polishing, a polishing liquid, e.g., an abrasive polishing slurry, is supplied to the surface of the polishing pad by a polishing liquid delivery arm. For example, the polishing liquid delivery arm can have a nozzle that dispenses the polishing liquid onto the surface of the polishing pad. As the polishing liquid impacts the polishing pad, some polishing liquid can be deflected upwards and form airborne droplets. These droplets can accumulate on the polishing liquid delivery arm. In addition, polishing liquid can be scattered off the polishing pad by other components, e.g., the carrier head or conditioner head.

Although some of the polishing liquid will flow off the delivery arm and can be collected in a basin, some of the polishing liquid can dry and build up on the delivery arm. The build-up over time of dried polishing liquid on the delivery arm has multiple deleterious effects. For example, abrasive particles in the polishing liquid can form agglomerates which can later be dislodged from the delivery arm and be deposited on to the polishing surface, thus creating the danger of scratching and defects. A significant amount of non-productive time and operator effort is required to clean the polishing liquid delivery arm to prevent build-up of the dried polishing liquid.

A polishing liquid delivery arm cleaning tool that can be easily attached to the polishing liquid delivery arm and that does not require equipment dis-assembly can alleviate these deleterious effects.

Figure 1A:
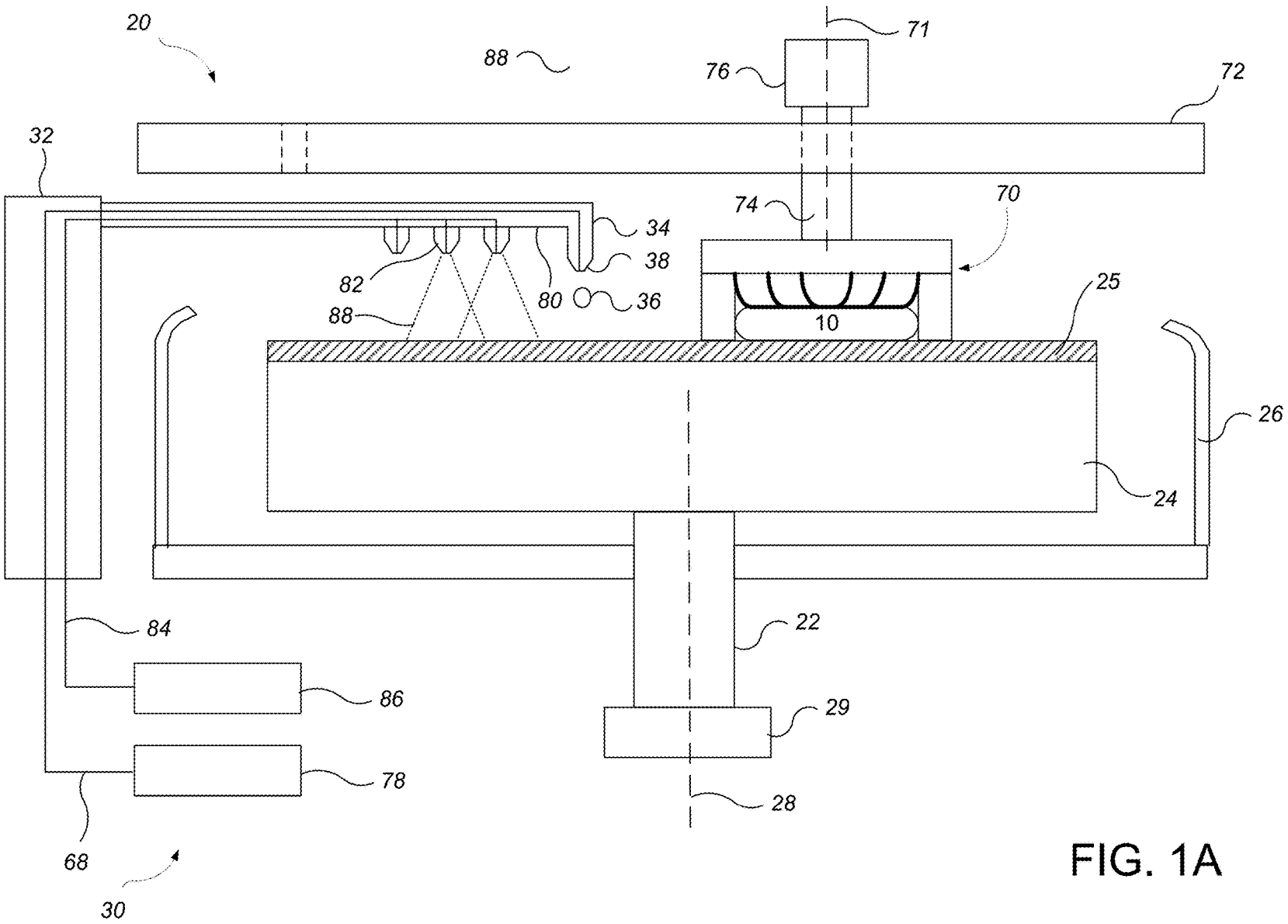
FIG. 1A shows a schematic cross-sectional view of a chemical mechanical polishing system.

FIG. 1A shows a polishing system 20 operable to polish a substrate 10. The polishing system 20 includes a rotatable platen 24, on which a polishing pad 25 is situated, and a platen shield 26 surrounding the rotatable platen 24. The rotatable platen 24 is operable to rotate about an axis 28. For example, a motor 29 can turn a drive shaft 22 to rotate the rotatable platen 24.

The polishing system 20 includes a carrier head 70 operable to hold the substrate 10 against the polishing pad 25. The carrier head 70 is suspended from a support structure 72, for example, a carousel or track, and is connected by a carrier drive shaft 74 to a carrier head rotation motor 76 so that the carrier head can rotate about an axis 71. In addition, the carrier head 70 can oscillate laterally across the polishing pad 25, e.g., by moving in a radial slot in the carousel 72 as driven by an actuator, by rotation of the carousel as driven by a motor, or movement back and forth along the track as driven by an actuator. In operation, the platen 24 is rotated about its central axis 28, and the carrier head is rotated about its central axis 71 and translated laterally across the top surface of the polishing pad 25.

As shown in FIG. 1, the polishing system 20 also includes a polishing liquid delivery system 30. The polishing liquid delivery system 30 includes a polishing liquid delivery arm 34 that is supported over the platen 24 by a base 32. A port 38, which can be located at the end of the arm 34, is coupled by a fluid line 68, e.g., tubing, piping, a passages through a solid body, etc., to a polishing liquid source 78, e.g., a reservoir. The port 38 can be a nozzle. During polishing, the delivery arm 34 is operable to dispense a polishing liquid 36 from the port 38. The flow of the polishing liquid 36 through the fluid line 68 can be controlled by a liquid flow controller (LFC), which in turn can be controlled by a machine controller, e.g., a computer.

The polishing system 20 also includes one or more second ports 82, which can be located at the end of the arm 34 or along the arm. The second ports 82 are coupled by a fluid line 84, e.g., tubing, piping, a passages through a solid body, etc., to a cleaning fluid source 86, e.g., a reservoir. During cleaning, the delivery arm 34 is operable to dispense a cleaning fluid 88 from the ports 82. The second ports 82 can be nozzles, and the nozzles can spray the cleaning fluid onto the polishing pad 25. The cleaning fluid can be water, deionized water, or isopropyl alcohol solution. The flow of the cleaning fluid 88 through the fluid line 78 can be controlled by a liquid flow controller (LFC), which in turn can be controlled by a machine controller, e.g., a computer.

Figure 3B:
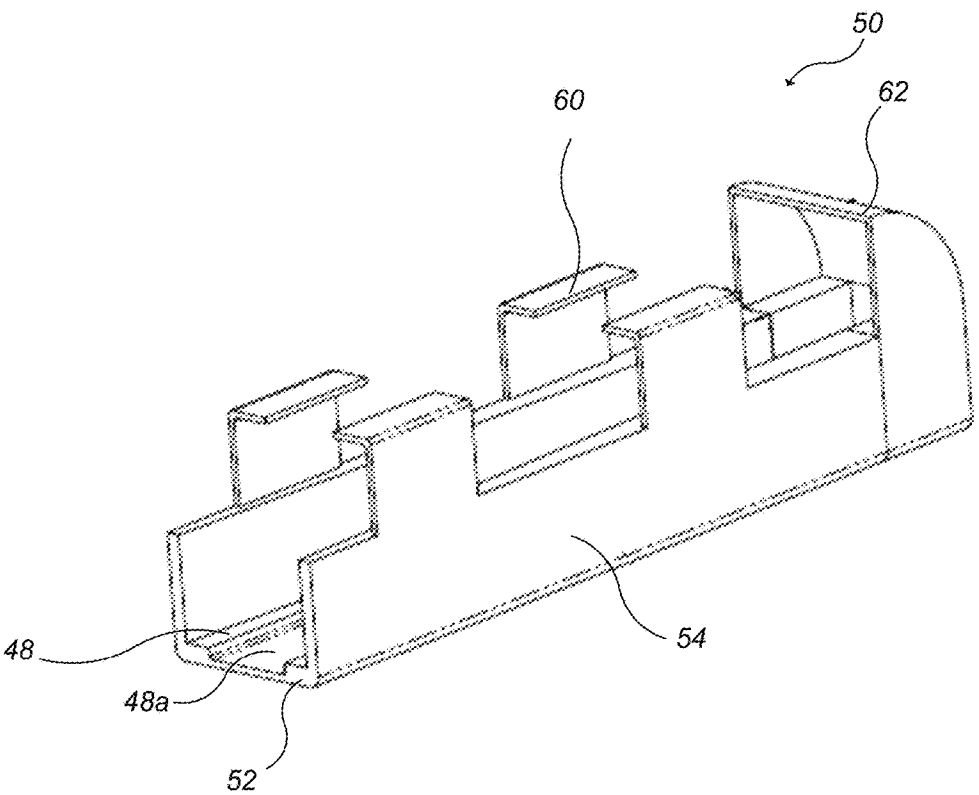
FIG. 3B shows a perspective view of the polishing liquid delivery arm cleaning tool of FIG. 2.
Figure 3A:
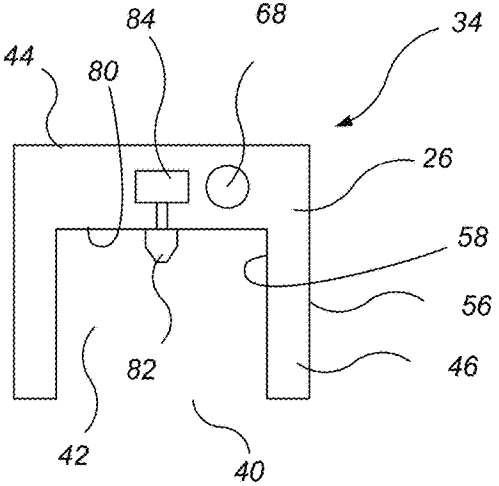
FIG. 3A shows a cross section view of the polishing liquid delivery arm of the chemical mechanical polishing system of FIG. 1A.

Referring to FIGS. 3A, the polishing liquid delivery arm 34 can form an enclosure 26 that is open at the bottom 40. In particular, the polishing liquid delivery arm 34 includes a roof 44 and side walls 46 that extend downwardly from the roof 44. An interior space 42 between a ceiling 80 is provided by the bottom of the roof 44 and the interior surfaces 58 of the side walls 46.

During a cleaning operation, the cleaning liquid 36 flows downwardly through the interior space 42 of the enclosure 26 onto the polishing pad 25. The enclosure 26 can be useful for restraining spray of the cleaning fluid from ports 82 and/or off the polishing pad 25.

In other implementations, the ports in the polishing liquid delivery arm 34 can switch between delivering polishing liquid 36 and cleaning fluid 82. In other implementations, the polishing liquid delivery arm 34 can have one nozzle, e.g., the nozzle at the end of the arm 34, configured to switch between delivering polishing liquid 36 and cleaning fluid 82.

Although FIG. 3A illustrates the polishing fluid line 68 and the cleaning fluid line 84 as passages within a solid body, this is not necessary. One or both fluid lines could be provided by piping or flexible tubing inside a cavity of the arm, or on the top of the arm.

The polishing liquid 36 can be a slurry with abrasive particles. As the polishing liquid delivery arm 34 dispenses the polishing liquid 36 through nozzles 38, the nozzles 38 direct the polishing liquid 36 to the surface of the polishing pad 10. As the polishing liquid 36 impacts the polishing pad 25, some polishing liquid 36 can be reflected upward and forms droplets. Although some of the polishing liquid 36 will flow off the polishing arm 34 and back onto the polishing pad 25 and can be collected in a basin, some of the polishing liquid 36 can dry and build up on the polishing liquid delivery arm 34, e.g., on the interior surface 58 of the side walls 46, on the ceiling 80, and on the nozzles 38. Subsequent polishing operations will continue to deposit polishing liquid 36 on the polishing liquid delivery arm 34, and the polishing liquid 36 can dry and further accumulate on the polishing liquid delivery arm 34.

Figure 1B:
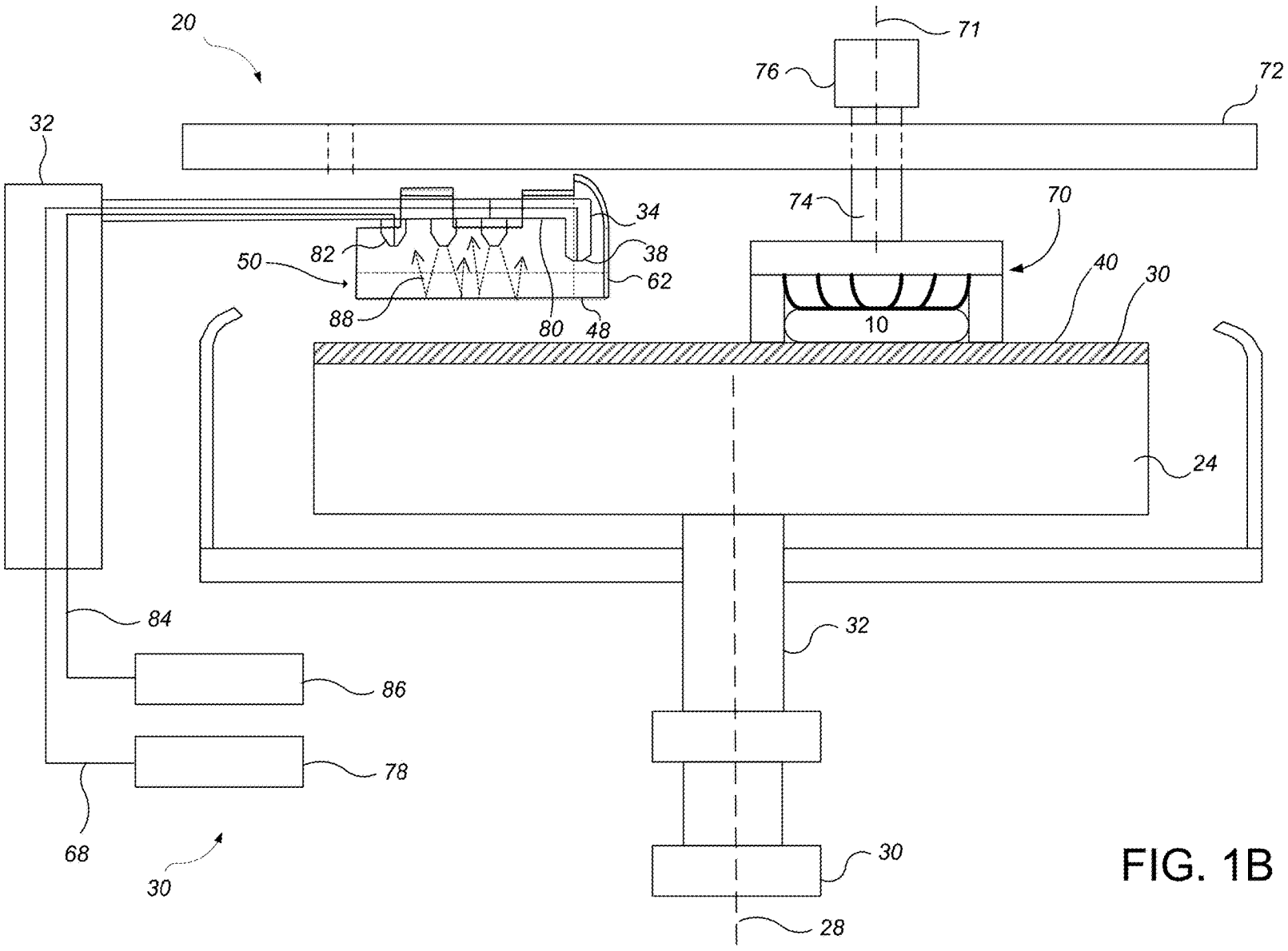
FIG. 1B shows a schematic cross-sectional view of a polishing liquid delivery arm cleaning tool installed on the polishing liquid delivery arm of the chemical mechanical polishing system of FIG. 1A.
Figure 2:
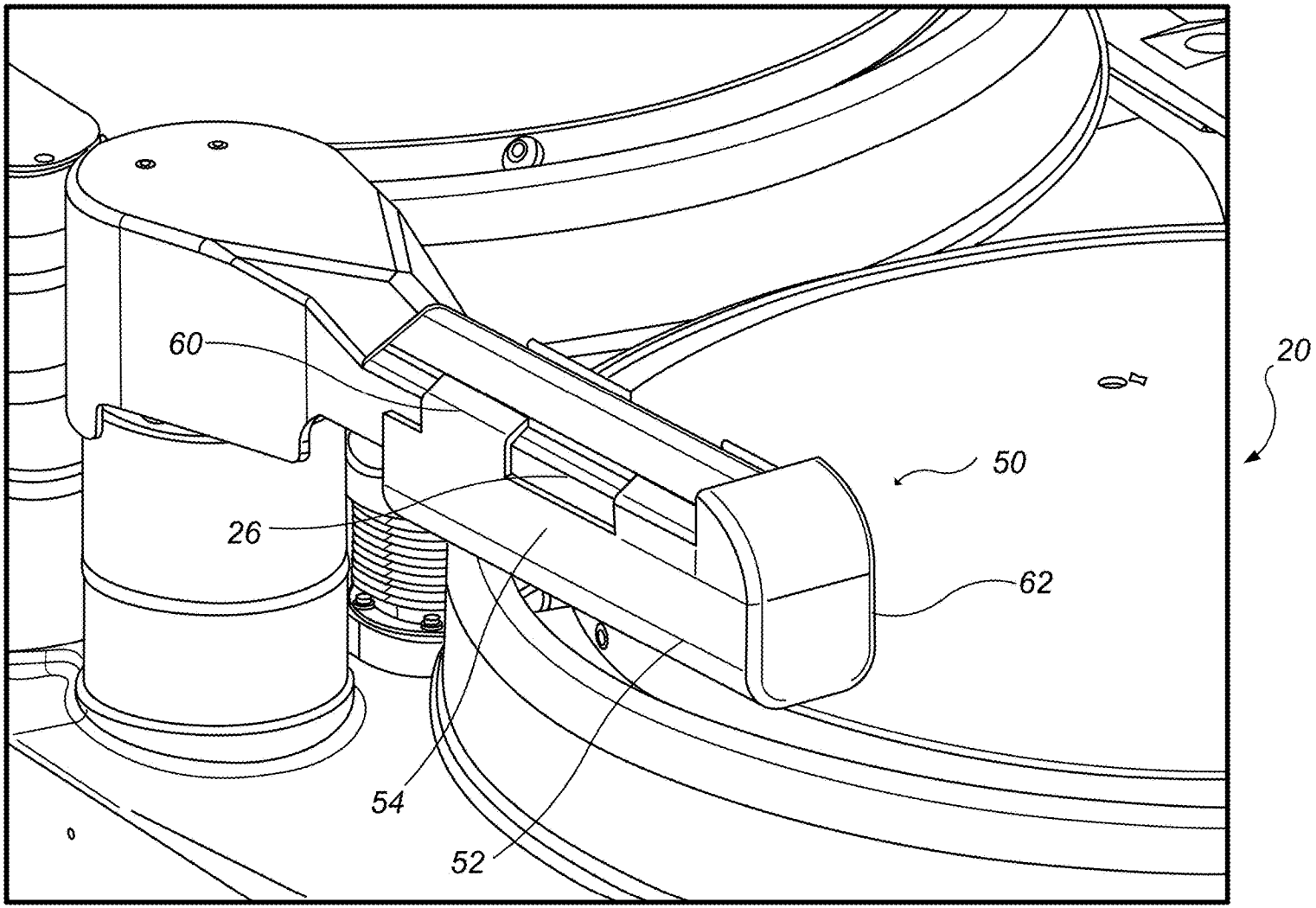
FIG. 2 shows a perspective view of the polishing liquid delivery arm cleaning tool installed on the on the polishing liquid delivery arm of a chemical mechanical polishing system.

A polishing liquid delivery arm cleaning tool 50 can be removably attached to the delivery arm 34. In general, the cleaning tool 50 forms a shell that, when installed on the delivery arm, covers at least the bottom of the enclosure 26. FIGS. 1B and 2 shows a polishing liquid delivery arm cleaning tool 50 installed on the polishing liquid delivery arm 34. When installed, the cleaning tool 50 extends below the delivery arm 34. In this configuration, the cleaning fluid 88 flows downwardly through the interior space 42 of the enclosure 26 and impacts the polishing liquid delivery arm cleaning tool 50, as shown in FIG. 1B, and is redirected to the ceiling 80 of the interior of the polishing liquid delivery arm 37.

The polishing liquid delivery arm cleaning tool 50 has a floor 52 and side walls 54 that extend upwardly from the floor 52. When installed, the floor 52 extends below and across the width of the polishing liquid delivery arm 34, and the side walls 54 extend along an outer surface 56 of the delivery arm 36.

The cleaning tool 50 can include multiple retaining tabs 60 to support the cleaning tool on the arm 34. Each retaining tab 60 can extend from a side wall 54 and can curve inwardly, i.e., toward the opposite side wall. Thus, when the cleaning tool 50 is slid onto the arm 34, the retaining tabs 60 extend over the roof 44 of the polishing liquid delivery arm 34 to secure the cleaning tool 50 to the polishing liquid delivery arm 34 (see FIG. 3C).

A front end of the cleaning tool 50 is enclosed by a front cover 62. The front cover 62 can connect the side walls 54 and extends over the space therebetween into which the arm 34 will fit. The front cover 62 prevents cleaning fluid from splashing out the front of the cleaning tool 50. A back end of the cleaning tool 50 is open so that the cleaning tool can be slid onto the arm 34. Other than the front cover 62, the cleaning tool 50 can be open on top.

Figure 4:
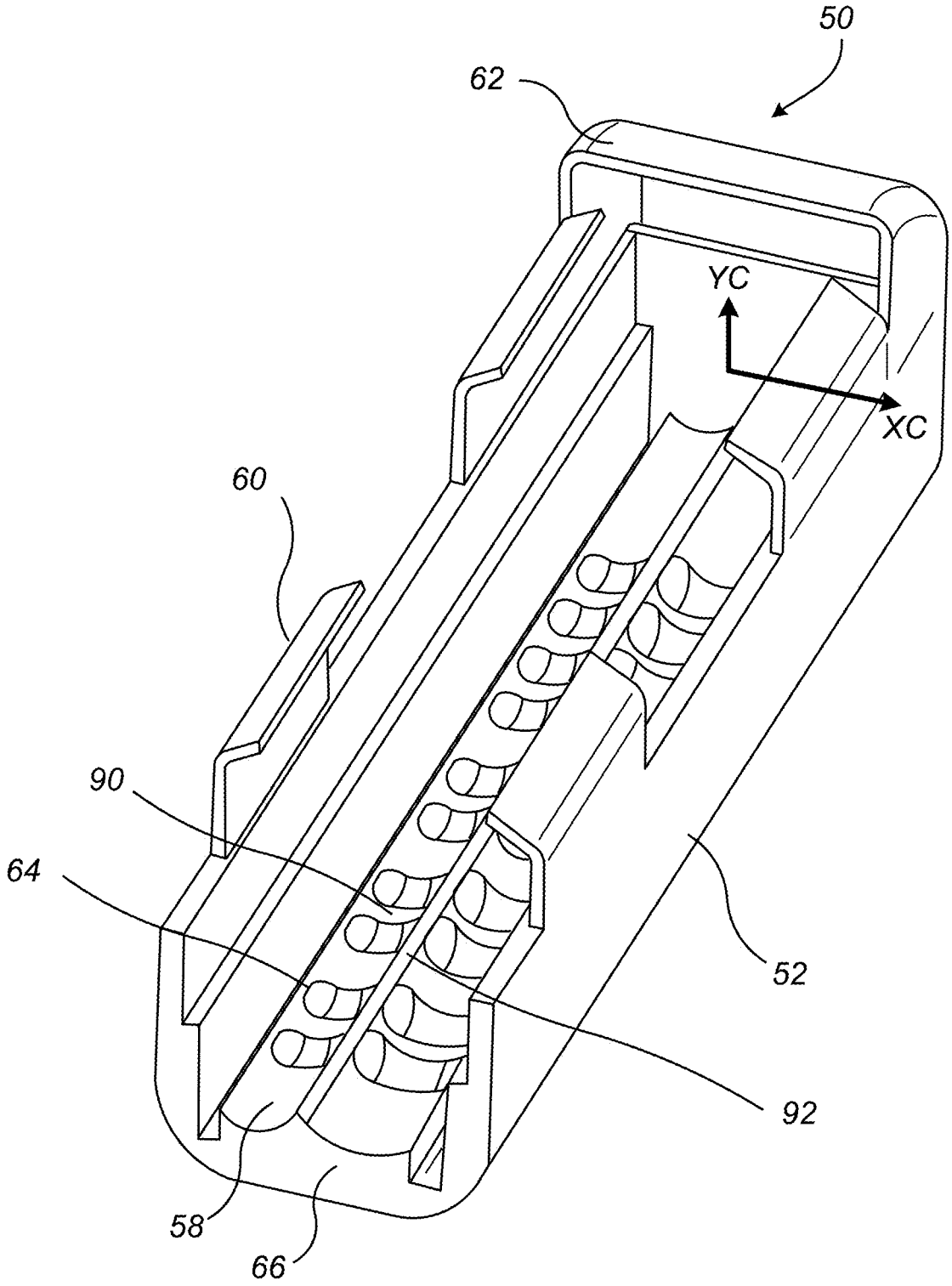
FIG. 4 shows a rear perspective view of the polishing liquid delivery arm cleaning tool with pockets of FIG. 2.

Referring to FIG. 4, the polishing liquid delivery arm cleaning tool 50 has a delivery arm-facing surface 48 shaped such that the polishing liquid delivery arm cleaning tool 50 directs the cleaning fluid from the polishing liquid delivery arm 34 on to an inner surface 58 of the side walls 46, onto the ceiling 80, and onto the nozzles 38 of the polishing liquid delivery arm 34. The arm-facing surface 48 can have one or more concavities 64 to direct the cleaning fluid back up toward the interior surfaces of the enclosure, e.g., the ceiling 80 and inside surfaces 58 of the side walls 46.

Figure 5:
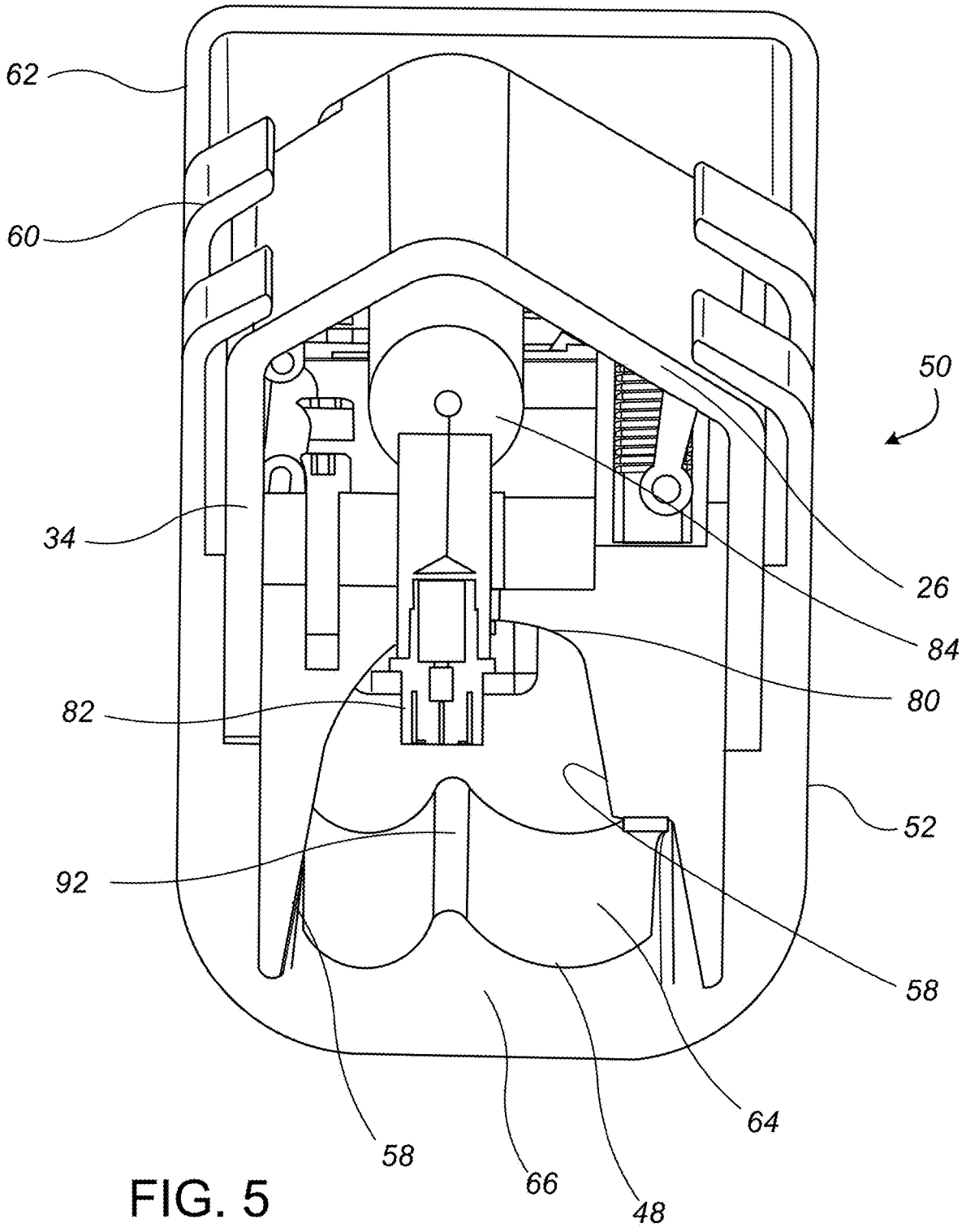
FIG. 5 shows a cross section view of the polishing liquid delivery arm cleaning tool of FIG. 2.

As shown in FIG. 4, the concavities 64 can be semi-circular troughs. Alternatively, as shown in FIG. 5, the concavities 64 can be cylindrical. The curvature of the concavities 64 is configured so that the initial momentum of droplets of the cleaning fluid 88 travelling downwardly will carries the droplets 88 around the curve and back upward onto the interior surface 58 of the walls and ceiling 80. In some implementations, a ridge 90 separates one concavity 64 from another concavity 64. The concavity 64 can be separated from another concavity by more than one ridge. For example, a second ridge 92 can run in direction perpendicular to the ridge 90. The ridge 90 can be located directly below the nozzles 38 to split the cleaning fluid 88 spray, so one portion of the spray is redirected to one location and another portion of the spray is redirected to another location so half of spray is directed to each side on the inner surface 58 of the side walls 46 and the ceiling 80 and the nozzles 38 of the polishing liquid delivery arm 34.

In some implementations, the arm-facing surface 48 is a top surface of the body 52.

Figure 3C:
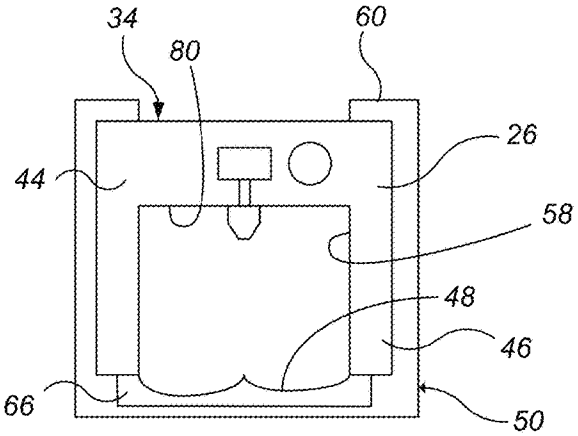
FIG. 3C shows a cross view of the polishing liquid delivery arm cleaning tool secured to the polishing liquid delivery arm.

In some implementations, the body 52 can be configured to accept an insert 66 (see FIG. 3C). The insert 66 is removably secured to the body 52. For example, the insert 66 can be slid into a guide recess 48*a* (see FIG. 3B) on a top of the body 52. The arm-facing surface 48 can be a top surface of the insert 66 such that the insert 66 directs the cleaning fluid from the polishing liquid delivery arm back 34 to the inner surface 58 and the nozzles 38 of the polishing liquid delivery arm.

Figure 6A:
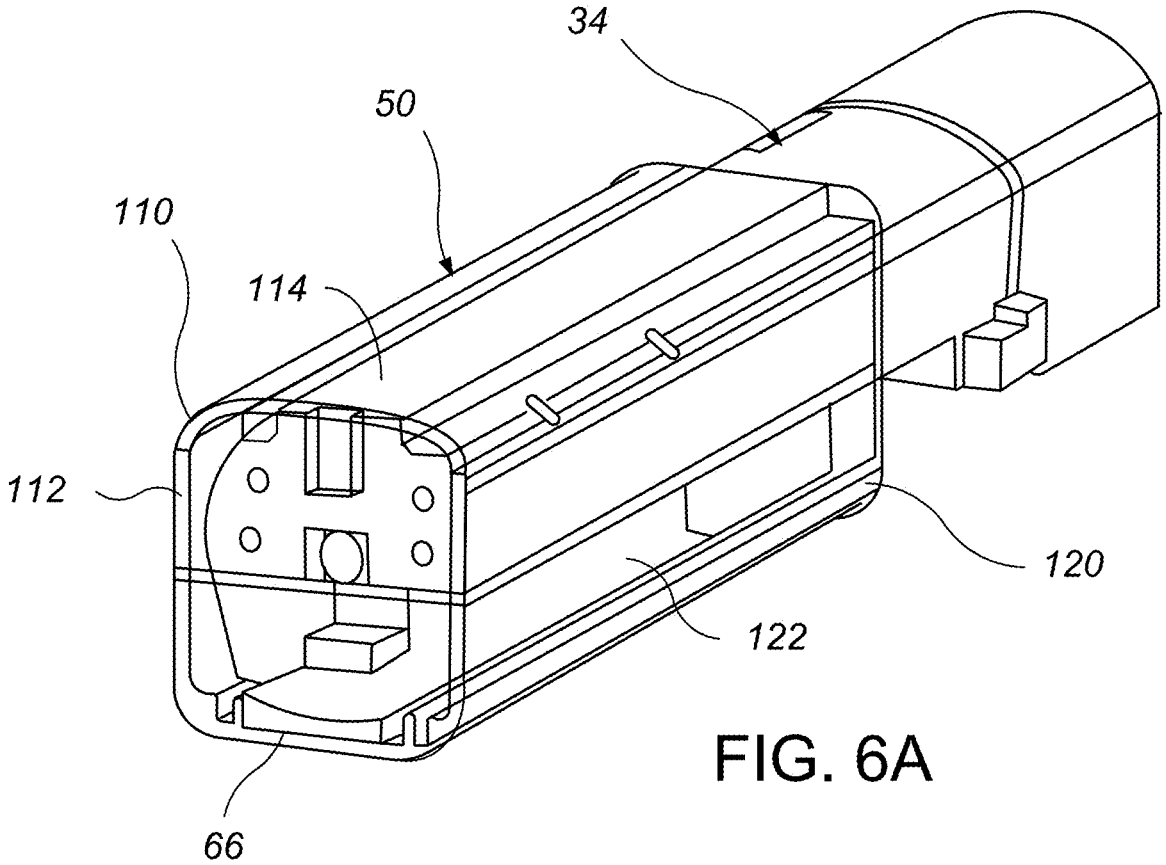
FIG. 6A shows a perspective view of another implementation of the polishing liquid delivery arm cleaning tool installed on the polishing liquid delivery arm of a chemical mechanical polishing system.
Figure 6B:
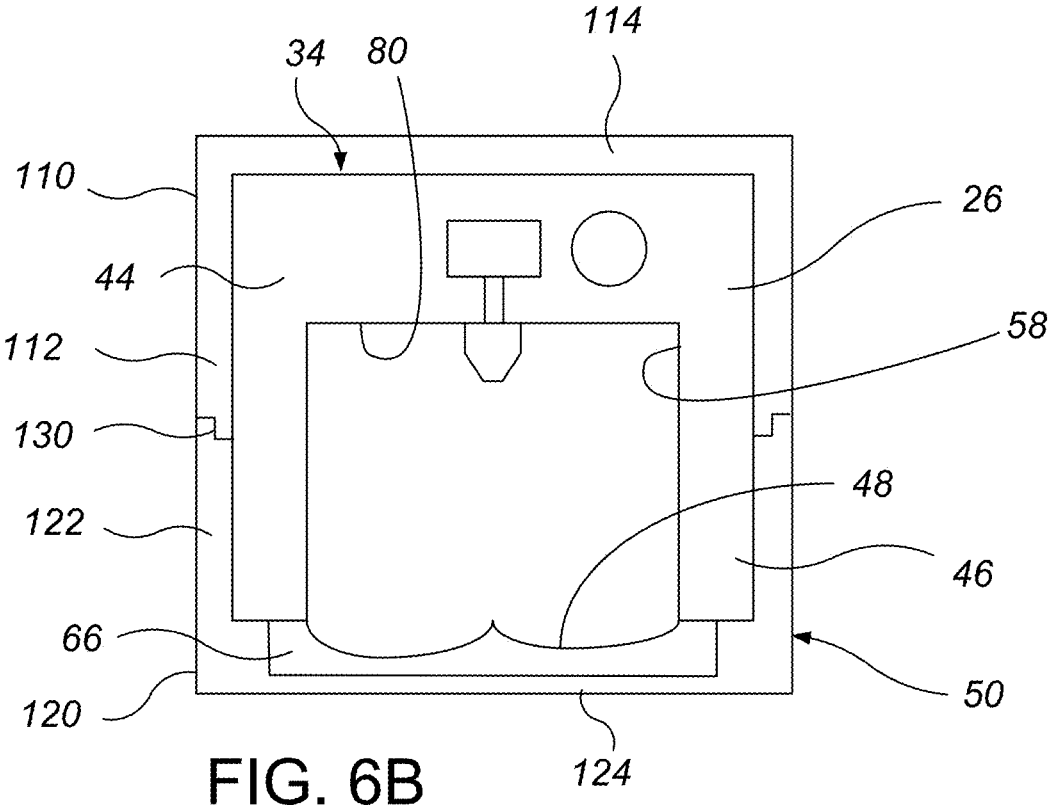
FIG. 6B shows a cross section view of the polishing liquid delivery arm cleaning tool of FIG. 6A.

Referring to FIGS. 6A and 6B, rather than a body that is suspended from tabs, the polishing liquid delivery arm cleaning tool 50 can include an upper cover 110 and a lower cover 120 that can be detachably secured together to form a shell that completely surrounds (around a cross-section transverse to the length of the arm as shown in FIG. 6B) the polishing liquid delivery arm 34. For example, the upper cover 110 can include sidewalls 112 extending downwardly from the edges of a ceiling piece 114, and the lower cover 120 can include sidewalls 122 extending upwardly from the edges of a floor piece 124. The side walls 112 of the upper cover 110 can be attached to the side walls 122 of the lower cover 120, e.g., by a friction fit 130. The front cover 62 of the cleaning tool 50 can similarly be provided by the sidewalls 112, 122 of the upper and lower covers 110, 120. For assembly, the lower cover 110 can be positioned below the polishing liquid delivery arm 34, and the upper cover 120 can be lowered into position to mate with the lower cover 110, thus enclosing the arm 34.

Figure 7B:
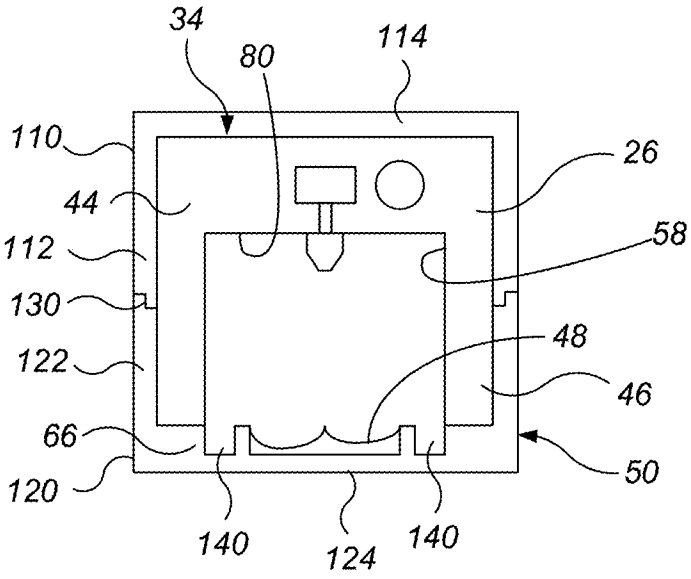
FIG. 7B a shows a cross section view of the polishing liquid delivery arm cleaning tool of FIG. 7A.
Figure 7A:
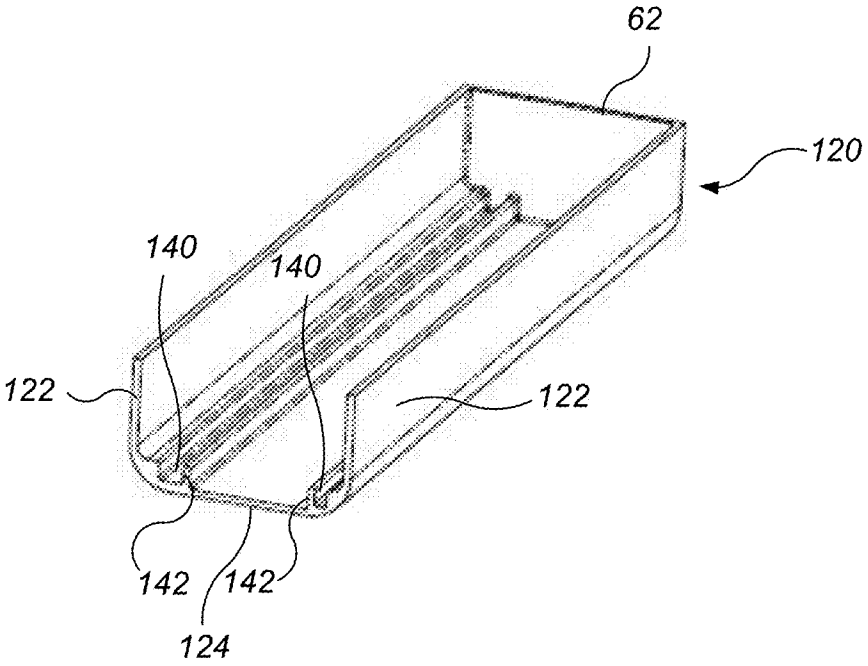
FIG. 7A shows a cross-sectional perspective view of a lower portion of another implementation of the polishing liquid delivery arm cleaning tool.

Referring to FIGS. 7A and 7B, the floor piece 124 of the lower cover 120 (or the floor of the single-piece tool of FIGS. 3A-3B) can include one or more channels 140 for excess cleaning liquid to drain out of the tool 50. In some implementations, there are two channels 140, one on each side of the insert 48. The channels 140 can be adjacent the sidewalls 122. In particular, two parallel linear protrusion 142 can extend from the floor piece 124, and the space between the protrusions 142 and the side walls 122 can provide the channels 140. The insert 66 can fit on the floor piece 124 between the two protrusions 142. One end of each channel is blocked off by the front cover 62, but the cleaning liquid can drain out the opposite end.

The polishing liquid delivery arm cleaning tool 50 can made of a metal or a plastic. For example, the cleaning tool 50 can be steel, aluminum, high density polyethylene, or a composite material.

Figure 8:
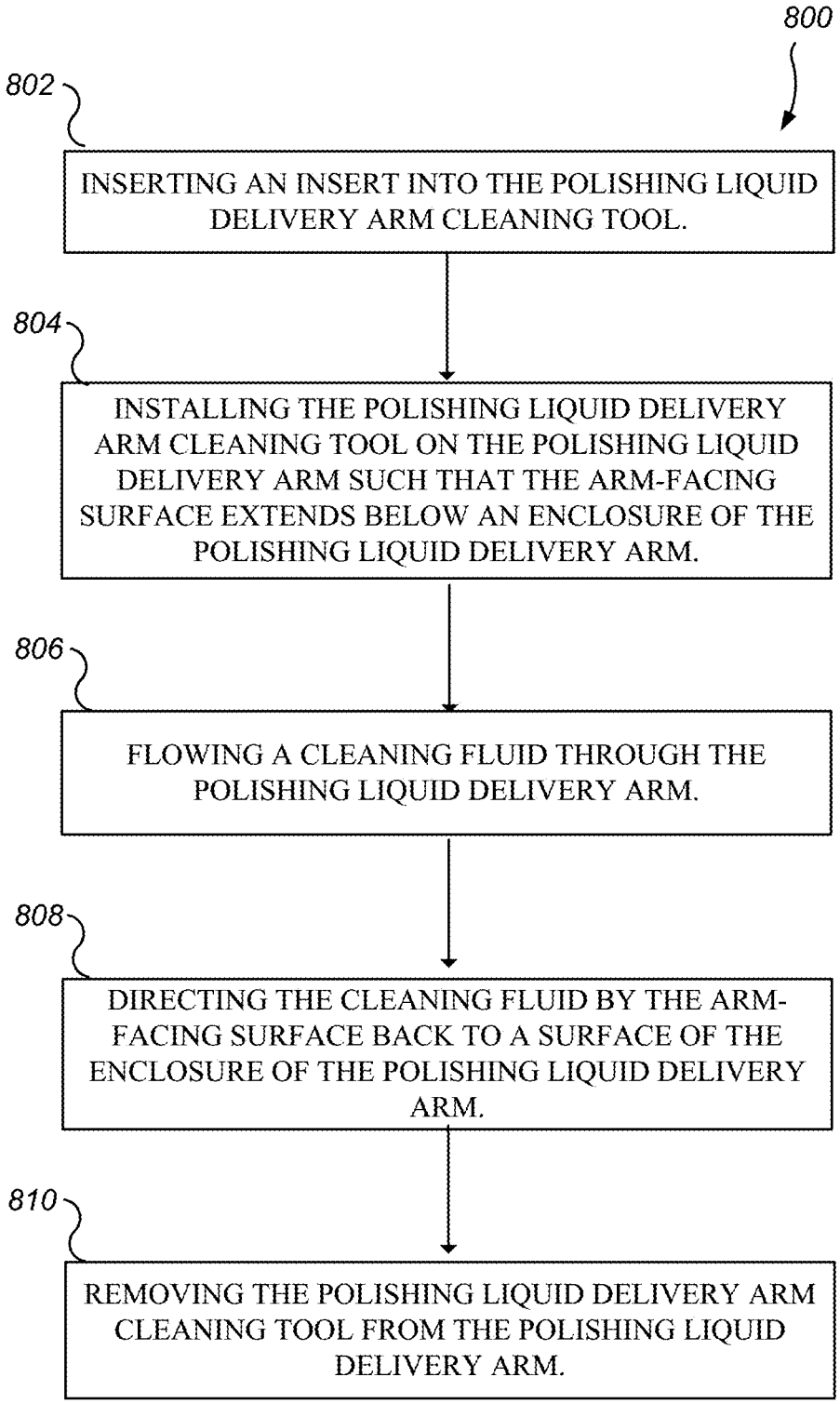
FIG. 8 shows a method of cleaning a polishing liquid delivery arm.

FIG. 8 shows a method 800 of cleaning the polishing liquid delivery arm with the polishing liquid delivery arm cleaning tool. An insert can be inserted into the cleaning tool (802). The insert has an arm-facing surface shaped such that the insert will direct the cleaning fluid from the polishing liquid delivery arm back to the surface of the polishing liquid delivery arm. The insert can have multiple pockets to direct the cleaning fluid. The polishing liquid delivery arm cleaning tool is installed on the polishing liquid delivery arm such that the arm-facing surface extends below an enclosure of the polishing liquid delivery arm (804). The polishing liquid delivery arm cleaning tool retaining tabs are engaged over a top of the polishing liquid delivery arm. A cleaning fluid flows through the polishing liquid delivery arm (806). The cleaning fluid is directed by the arm-facing surface back to a surface of the enclosure of the polishing liquid delivery arm (808). The polishing liquid delivery arm cleaning tool is removed from the polishing liquid delivery arm (810).

A number of embodiments have been described. Nevertheless, it will be understood that various modifications may be made. Accordingly, other embodiments are within the scope of the following claims.

What is claimed is:

1. A polishing liquid delivery arm cleaning kit, comprising:

an upper cover configured to be removably fit over a polishing liquid delivery arm;

a lower cover configured to be removably fit below the polishing liquid delivery arm and detachably securable to the upper cover to form a shell surrounding the polishing liquid delivery arm; and an insert removably supported by the lower cover, the insert having an arm-facing surface shaped to direct cleaning fluid projected downwardly from the polishing liquid delivery arm back toward the polishing liquid delivery arm.

2. The kit of claim 1, wherein the upper cover and lower cover are detachably securable by a friction fit.

3. The kit of claim 1, wherein a floor of the lower cover includes a first linear protrusion extending parallel to a first sidewall of the lower cover and a second linear protrusion extending parallel to a second sidewall of the lower cover, and a space between the first linear protrusion and the first sidewall provides a first channel and a space between the second linear protrusion and the second sidewall provides a second channel.

4. The kit of claim 3, wherein the insert fits on the floor of the lower cover between the first linear protrusion and second linear protrusion.

5. The kit of claim 1, wherein the shell is configured to be closed over an end of the polishing liquid delivery arm.

6. The kit of claim 1, wherein the arm-facing surface has a plurality of concavities to direct the cleaning fluid.

7. The kit of claim 6, wherein the plurality of concavities comprises two troughs that extend in parallel and parallel to side walls of the shell.

8. The kit of claim 7, wherein a first of the two troughs is wider than a second of the two troughs.

9. The kit of claim 7, wherein a ridge between the two troughs is positioned to be below cleaning fluid nozzles of the polishing liquid delivery arm when the lower cover is fit below the polishing liquid delivery arm.

10. A polishing liquid delivery arm cleaning tool comprising:

a body having a floor, a pair of sidewalls, and tabs projecting upward from the sidewalls to extend over a top of a polishing liquid delivery arm to removably secure the body to the polishing liquid delivery arm; and an insert removably secured to the body, the insert having an arm-facing surface shaped to direct a cleaning fluid from the polishing liquid delivery arm back to an inner surface of an enclosure of the polishing liquid delivery arm.

11. The tool of claim 10, wherein the arm-facing surface has a plurality of concavities to direct the cleaning fluid.

12. The tool of claim 11, wherein the plurality of concavities comprise two semi-circular troughs that extend in parallel and parallel to side walls of the body.

13. The tool of claim 11, wherein the arm-facing surface has a first ridge that extends parallel to side walls of the body.

14. The tool of claim 13, wherein the arm-facing surface comprises a plurality of second ridges that extend perpendicular to the first ridge.

15. The tool of claim 14, wherein the arm-facing surface comprises a plurality of pockets between the plurality of second ridges.

* * * * *